US006218985B1

(12) United States Patent
Adams

(10) Patent No.: US 6,218,985 B1
(45) Date of Patent: Apr. 17, 2001

(54) ARRAY SYNTHESIS METHOD

(75) Inventor: Richard C. Adams, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/292,150

(22) Filed: Apr. 15, 1999

(51) Int. Cl.[7] ..... H01Q 3/22; H01Q 3/24; H01Q 3/26

(52) U.S. Cl. ..... 342/372; 342/157

(58) Field of Search ..... 342/372, 157, 342/154, 158

(56) References Cited

U.S. PATENT DOCUMENTS

| | | | | |
|---|---|---|---|---|
| 3,368,202 | | 2/1968 | Crousel . | |
| 3,478,358 | | 11/1969 | Trigon . | |
| 3,478,359 | | 11/1969 | Salmon . | |
| 3,482,244 | | 12/1969 | Gadenne . | |
| 3,482,245 | | 12/1969 | Le Parquier . | |
| 3,560,985 | | 2/1971 | Lyon . | |
| 3,680,109 | | 7/1972 | Steudel . | |
| 3,877,012 | | 4/1975 | Nelson . | |
| 4,578,680 | * | 3/1986 | Haupt | 343/703 |
| 4,688,045 | | 8/1987 | Knudsen . | |
| 4,857,937 | | 8/1989 | Dadds . | |
| 5,166,690 | * | 11/1992 | Carlson et al. | 342/157 |
| 5,541,607 | * | 7/1996 | Reinhardt | 342/372 |
| 5,999,826 | * | 12/1999 | Whinnett . | |

* cited by examiner

*Primary Examiner*—Theodore M. Blum
(74) *Attorney, Agent, or Firm*—Harvey Fendelman; Eric James Whitesell; Peter A. Lipovsky

(57) ABSTRACT

A method for steering a beam of an antenna array minimizes a least squares approximation of an error function of a desired radiation pattern relative to an antenna array pattern calculated from a known radiation pattern for each antenna element.

6 Claims, 7 Drawing Sheets

70
START
CALCULATE BEAMFORMING MATRIX Z:
$Z(n,m) = e(\Phi_m - \Phi_n)\exp(2\pi jf\{x_n\cos(\Phi_m) + y_n\sin(\Phi_m)\}/c)$
702
CALCULATE Q MATRIX:
$Q(n,k) = \sum_{m=1}^{M} Z(n,m)\,Z(k,m)^{*T}$
704
CALCULATE TRANSMIT SIGNAL AMPLITUDES $B_n$:
$B_n = \sum_{M=1}^{M}\left[F(\phi_m)\sum_{k=n1}^{n2} Z(k,m)^{*T}\,Q(k,n)^{-1}\right]$
706

ARRAY SYNTHESIS METHOD

LICENSING INFORMATION

The invention described below is assigned to the United States Government and is available for licensing commercially. Technical and licensing inquiries may be directed to Harvey Fendelman, Patent Counsel, Space and Naval Warfare Systems Center San Diego, Code D0012 Rm 103, 53510 Silvergate Avenue, San Diego, Calif. 92152; telephone no. (619)553-3001; fax no. (619)553-3821.

BACKGROUND OF THE INVENTION

The present invention relates generally to steered beam antenna arrays. More specifically, but without limitation thereto, the present invention relates to a method for selecting amplitudes and phases of a drive signal input to elements of a multiple element antenna to approximate a radiation pattern having a desired beamwidth, sidelobe level and gain.

Multiple element antennas, or antenna arrays, are used in many commercial and military systems. An example of such an antenna array used on surface ships is a circular array of 64 dipoles, where each dipole is inside a cavity. The power distribution and phase shift of the transmit signal input to each antenna element is typically controlled by phase shifters, switches, and a waveguide. The parameters of beamwidth, sidelobe level and gain are currently improved by increasing the size of the array. The larger array size has the disadvantage of consuming valuable space on the uppermost areas of the ship. Previous methods for optimizing performance of an antenna array calculate the amplitude and phase drive current at each antenna element to generate a desired beam pattern. These methods typically place the largest amplitudes in the center of the array and the smallest amplitudes at the ends of the array. A disadvantage of these methods is that a large array diameter is required to achieve stringent beamwidth, sidelobe level, and gain parameters.

A need therefore continues to exist for a method for meeting goals of beamwidth, sidelobe level, and gain parameters of an antenna array while decreasing the size of the array.

SUMMARY OF THE INVENTION

The method of the present invention is directed to overcoming the problems described above and may provide further related advantages. No embodiment of the present invention described herein shall preclude other embodiments or advantages that may exist or become obvious to those skilled in the art.

The method for steering a beam of an antenna array of the present invention minimizes a least squares approximation of an error function of a desired radiation pattern relative to an antenna array pattern calculated from a known radiation pattern for each antenna element.

An advantage of the method of the present invention is that a higher gain and narrower beamwidth may be obtained with a reduced array aperture.

Another advantage is that beam steering of an antenna array may be conveniently and rapidly implemented.

Yet another advantage is that the beam pattern may be preserved during transmissions of different frequencies by changing amplitude weights and phase shift angles for each antenna element in real time.

The features and advantages summarized above in addition to other aspects of the present invention will become more apparent from the description, presented in conjunction with the following drawings.

DESCRIPTION OF THE INVENTION

The following description is presented solely for the purpose of disclosing how the present invention may be made and used. The scope of the invention is defined by the claims.

Figure 1:
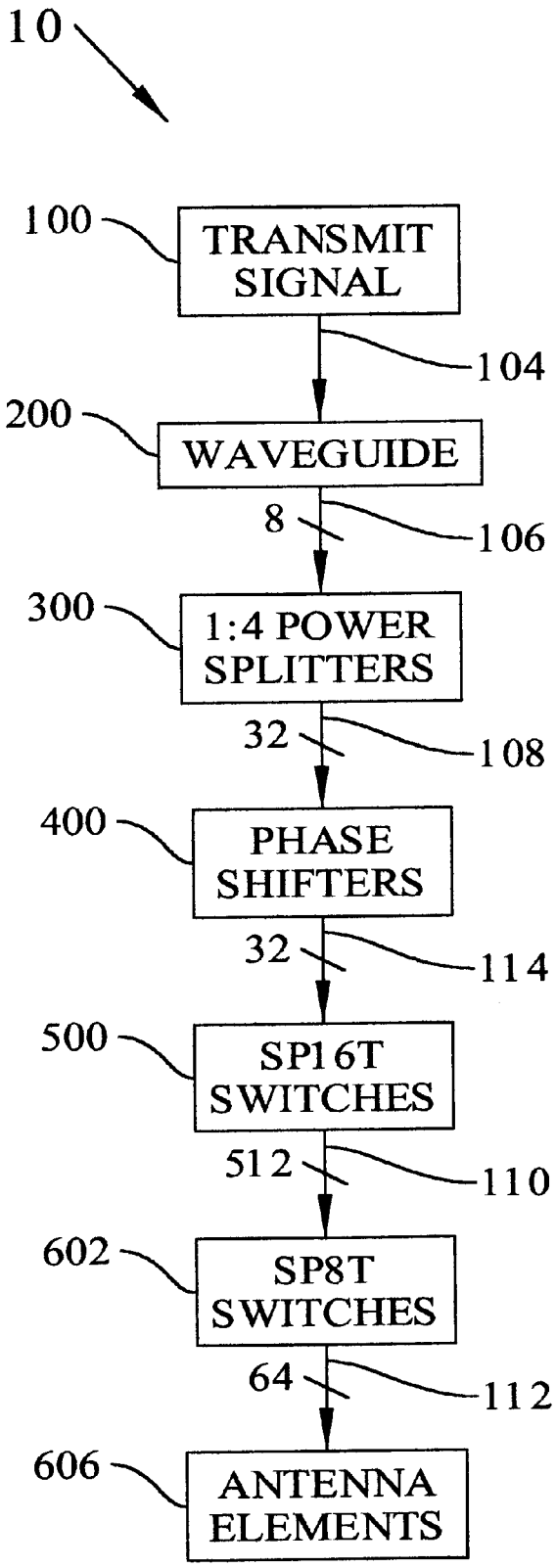
FIG. 1 is a block diagram of a configuration for practicing the method of the present invention with an antenna array having 64 antenna elements.

FIG. 1 is a block diagram of an example of an array synthesizer 10 suitable for practicing the method of the present invention to generate a radiation pattern having a desired beamwidth, sidelobe level and gain for a 64-element antenna array. A transmit signal 104 is generated by a transmit signal source 100 according to well known techniques. A waveguide 200 inputs transmit signal 104 and generates eight amplitude levels 106 that are input respectively to eight 1:4 power splitters 300. Each of power splitters 300 divides corresponding amplitude level 106 to produce a total of 32 splitter outputs 108. Each of 32 splitter outputs 108 is connected to one of 32 phase shifters 400. Each of 32 phase shifters 400 generates a phase-shifted output 114 from power splitter outputs 108 to one of 32 single-pole, 16-throw switches 500. Each of 32 single-pole, 16-throw switches 500 connects one of phase-shifted outputs 114 to one of 64 single-pole, eight-throw switches 602. Each of single-pole, eight-throw switches 602 selects one of phase-shifted outputs 114 to connect to one of 64 antenna elements 606.

Figure 2:
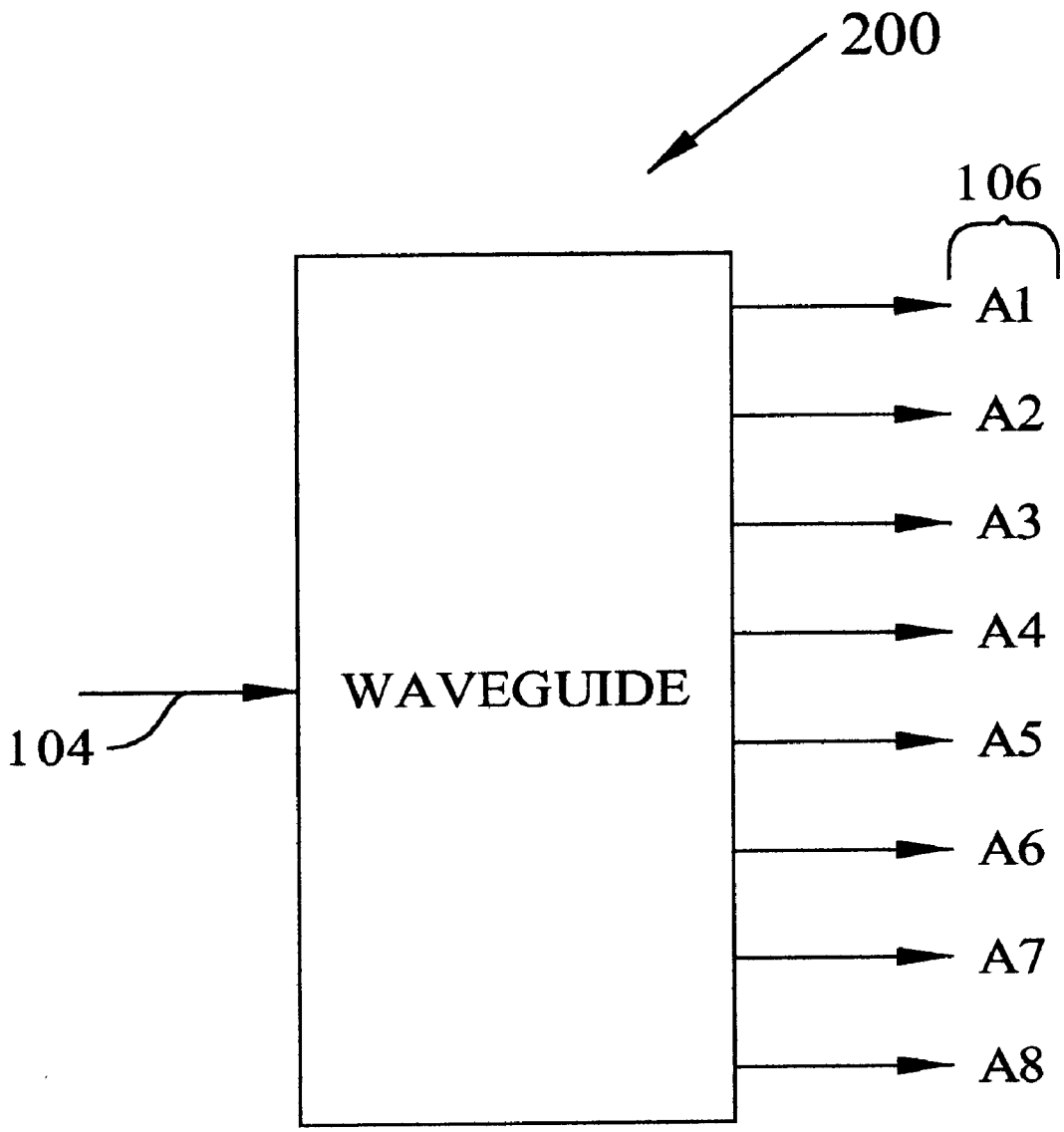
FIG. 2 is a diagram of a waveguide for FIG. 1.

FIG. 2 is a diagram of waveguide 200 in FIG. 1. Waveguide 200 divides transmit signal 104 into eight relative amplitude weights 106 having values A1–A8 respectively. Exemplary values for amplitude weights A1–A8 are: A1=1.0000, A2=0.9429, A3=0.7028, A4=0.5086, A5=0.3574, A6=0.2825, A7=0.2587, and A8=0.2512.

Figure 3:
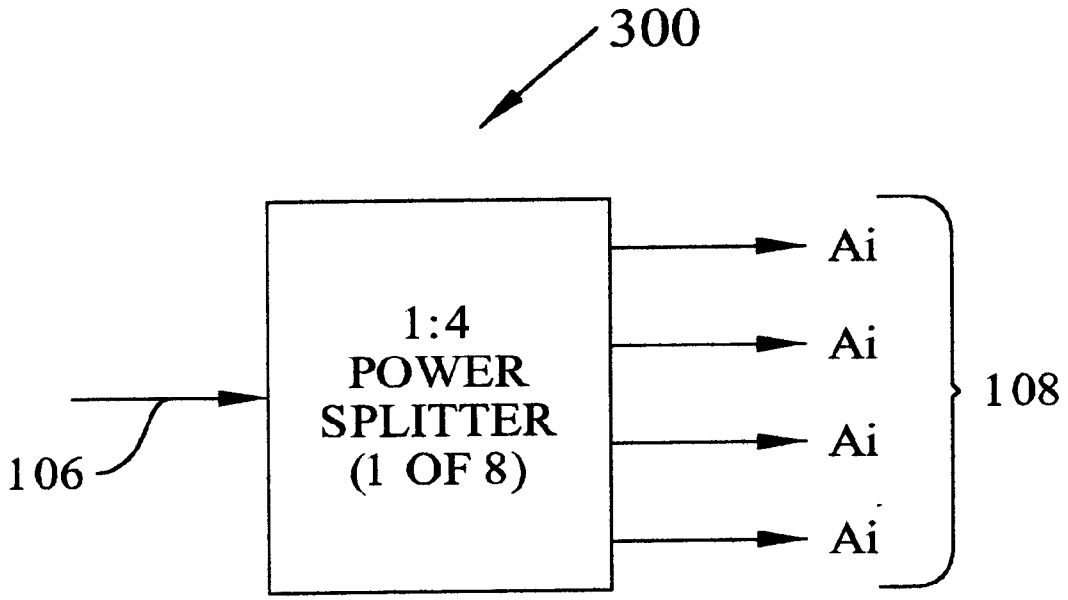
FIG. 3 is a diagram of a 1:4 power splitter for FIG. 1.

FIG. 3 is a diagram of one of eight power splitters 300. Each of power splitters 300 divides an amplitude weight from one of amplitude weights A1–A8 output from waveguide 200 into four splitter outputs Ai shown collectively as 108. Power splitters 300 may be, for example, commercially available power splitters or well known voltage dividers. In this example, a 1:4 power splitter is used.

Figure 4:
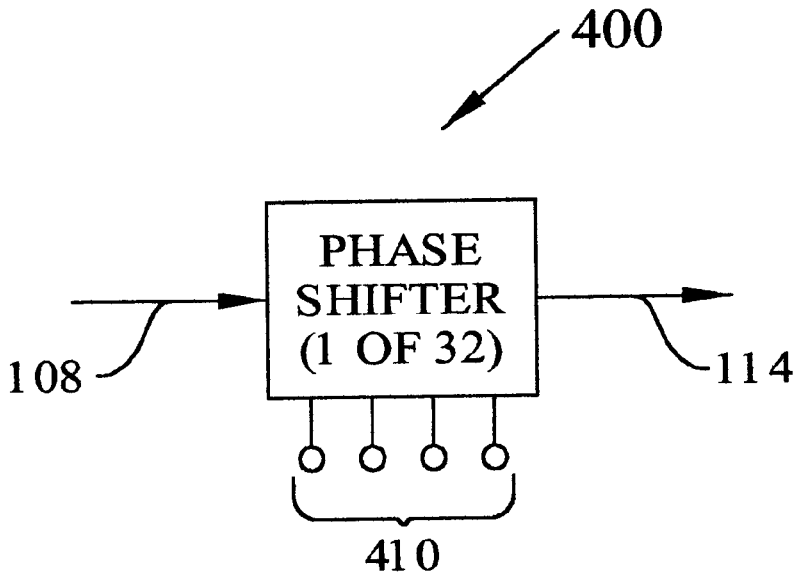
FIG. 4 is a diagram of a phase shifter for FIG. 1.

FIG. 4 is a diagram of one of 32 phase shifters 400. Each of phase shifters 400 is controlled by a digital input 410 that selects a phase shift angle equal to the product of 22.5 degrees multiplied by an integer from 0 to 15. Such digitally controlled phase shifters are readily available commercially.

Figure 5:
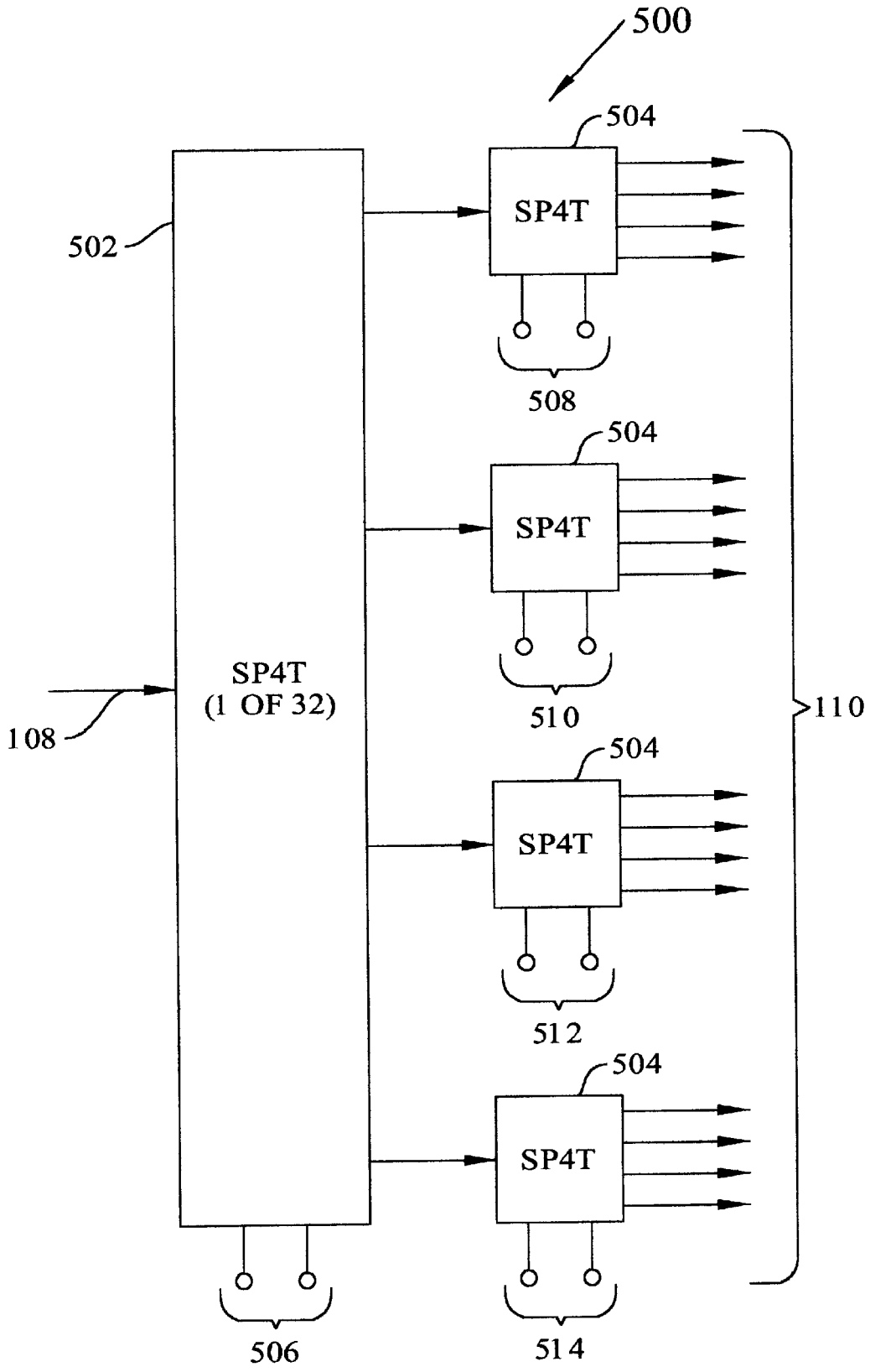
FIG. 5 is a diagram of a single-pole-16-throw switch for FIG. 1.

FIG. 5 is a diagram of one of 32 single-pole-16-throw (SP16T) switches 500. Each of SP16T switches 500 connects one of phase shifted outputs 114 to one of 16 switched outputs 110. In this example, each SP16T switch 500 is made of a single-pole, four-throw (SP4T) switch 502 cascaded with four additional SP4T switches 504. SP4T switches 502 and 504 are each controlled by two-line digital inputs 506–514 that select one of four switched outputs 110 for each SP4T switch 504.

Figure 6:
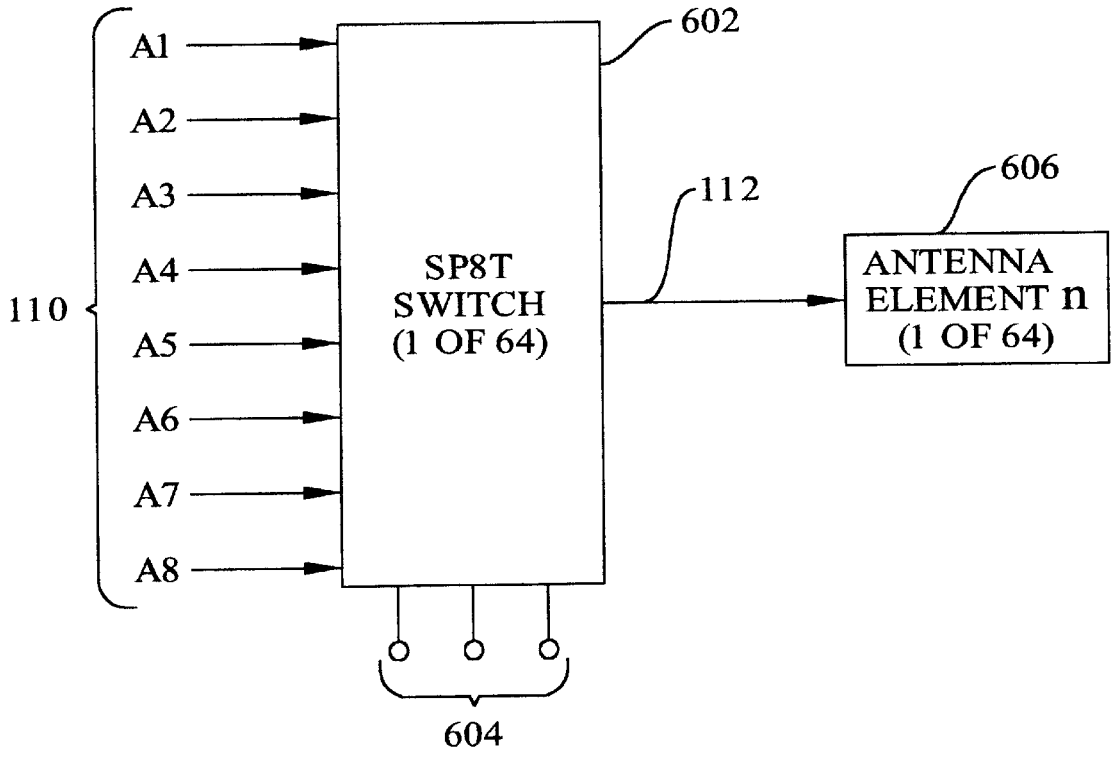
FIG. 6 is a diagram of a single-pole-eight-throw switch and an antenna element for FIG. 1.

FIG. 6 is a diagram of one of 64 single-pole-eight-throw (SP8T) switches 602. Each of single-pole-eight-throw (SP8T) switches 602 is controlled by a digital input 604 that selects one of switched outputs 110 to connect to each antenna drive output 112. Each antenna drive output 112 is connected to a corresponding $n^{th}$ antenna element 606 of the 64-element antenna array.

The array synthesis method of the present invention minimizes an error function of the desired beam pattern of the antenna array versus a calculated beam pattern of the antenna array from a sum of known electric fields of the antenna elements. The electric field of the antenna array is substantially equal to the sum of the electric fields of the antenna elements if each antenna element is isolated from the others by at least 20 dB. If the magnitude and phase of the electric field generated from each antenna element are known for a given transmit signal input to each antenna element, the electric field of the antenna array may be calculated for any transmit signal input to each antenna element by summing the weighted values of the known electric fields of the antenna elements.

An illustrative example is an antenna array in which the $n^{th}$ antenna element has an axis pointed toward an azimuth $\phi_n$ in the horizontal plane, a normalized electric field given by $e_n(\phi_n)$ per amp of input current, and a location given by $(x_n,y_n,z_n)$. An active sector of the antenna array, i.e., those antenna elements of the antenna array that are being driven, begins with the $n1^{th}$ element and ends at the $n2^{th}$ element. The resultant electric field of the antenna array as a function of azimuth $\phi$ may then be expressed as:

$$E(\Phi) = \sum_{n=n1}^{n2} B_n e_n(\Phi - \Phi_n)\exp(2\pi j f\{x_n\cos(\Phi) + y_n\sin(\Phi)\}/c) \tag{1}$$

where:

$B_n$≡complex current input to the $n^{th}$ antenna element;

$j \equiv \sqrt{-1}$;

f≡transmit signal frequency; and c≡speed of light.

The desired beam pattern $F(\phi)$ of the antenna array may be selected for M values of $\phi$, for example, M=360 for values of $\phi$ for 0° to 359° in one degree increments. The desired steered beam pattern $F(\phi_m)$, i.e. the desired electric field of the antenna array at azimuth m, has a dimension of 1×M. For an active sector of N elements of the antenna array where N=n2−n1+1, a beamforming matrix Z may be defined having dimensions N×M as follows:

$$Z(n,m)=e_n(\phi_m-\phi_n)\exp(2\pi jf\{x_n\cos(\phi_m)+y_n\sin(\phi_m)\}/c) \tag{2}$$

Let Q be the N×N matrix given by:

$$Q(n,k) = \sum_{m=1}^{M} Z(n,m)Z(k,m)^{*T} \tag{3}$$

where n and k are row and column indices that range from n1 to n2. The operator *T transforms an A×B input matrix into a B×A output matrix as follows. An A×B transform matrix is defined by taking the complex conjugate of each corresponding element of the A×B input matrix. The A×B transform matrix is then transposed to define the B×A output matrix.

An error function I that calculates the mean square error of the desired beam pattern of the antenna array relative to the calculated beam pattern of the antenna array may be calculated as follows:

$$I = \sum_{m=1}^{M} \left\{\left[F(\Phi_m) - \sum_{n=n1}^{n2} B_n Z(n,m)\right]\left[F^*(\Phi_m) - \sum_{k=n1}^{n2} B_k^* Z(k,m)^{*T}\right]\right\} \tag{4}$$

The values of $B_n$ that minimize the error function I may then be calculated as follows:

$$B_n = \sum_{m=1}^{M} \left[F(\Phi_m)\sum_{k=n1}^{n2} Z(k,m)^{*T} Q(k,n)^{-1}\right] \tag{5}$$

In equation (5) the assumption is made that the geometry of the array and the characteristics of each element are known and that the elements are isolated from each other by at least 20 dB. If the isolation between elements is less than 20 dB, the above equations may still be used as long as the coupling between the antenna elements is known and suitably accounted for.

The optimum relative amplitude weight $R_n$ of the input current to the $n^{th}$ antenna element may be calculated as follows:

$$R_n=B_n/\max(abs(B_n)) \tag{6}$$

In the example of FIG. 1, eight power levels are used with the relative amplitude weights A1–A8 defined above. Each optimum relative weight $R_n$ in equation (6) is approximated by selecting the closest value of A1–A8 input by corresponding SP8T switch 502 in FIG. 5. More than eight power levels may be used as well as a different selection of amplitude weights to more closely match the resultant beam pattern to the desired beam pattern.

The optimum phase shift angle $\theta_n$ for the $n^{th}$ antenna element may be calculated as follows:

$$\theta_n=\arctan[imag(R_n)/\mathrm{real}(R_n)] \tag{7}$$

Each optimum phase shift angle $\theta_n$ calculated from equation 7 is approximated by selecting the closest multiple of 22.5 degrees output to $n^{th}$ antenna element 506 from corresponding phase shifter 504 in FIG. 5.

Figures 7, 7A, 7B:
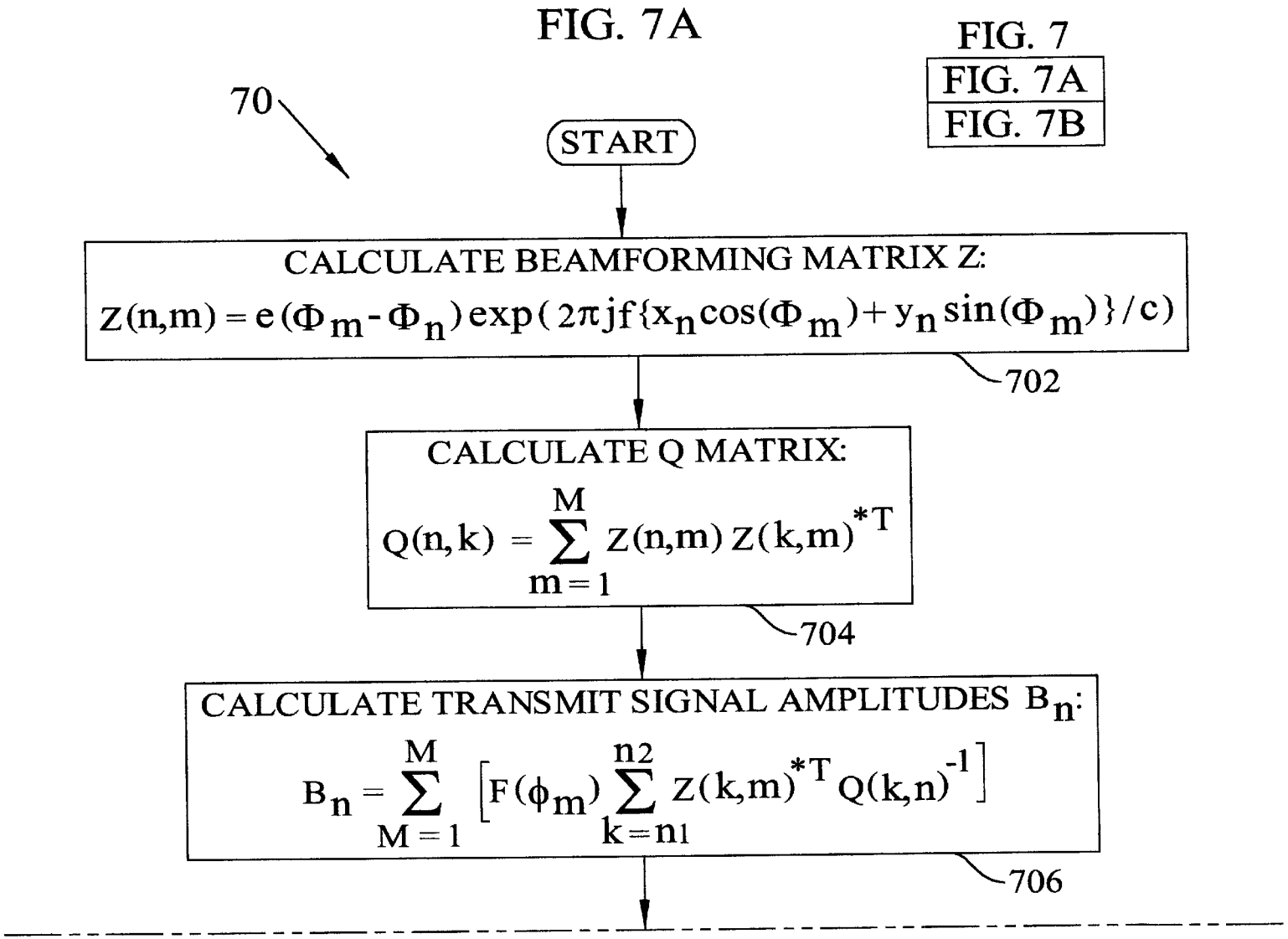
FIGS. 7, 7A, and 7B, show a flow chart of a computer program for practicing the present invention.
Figure 7B:
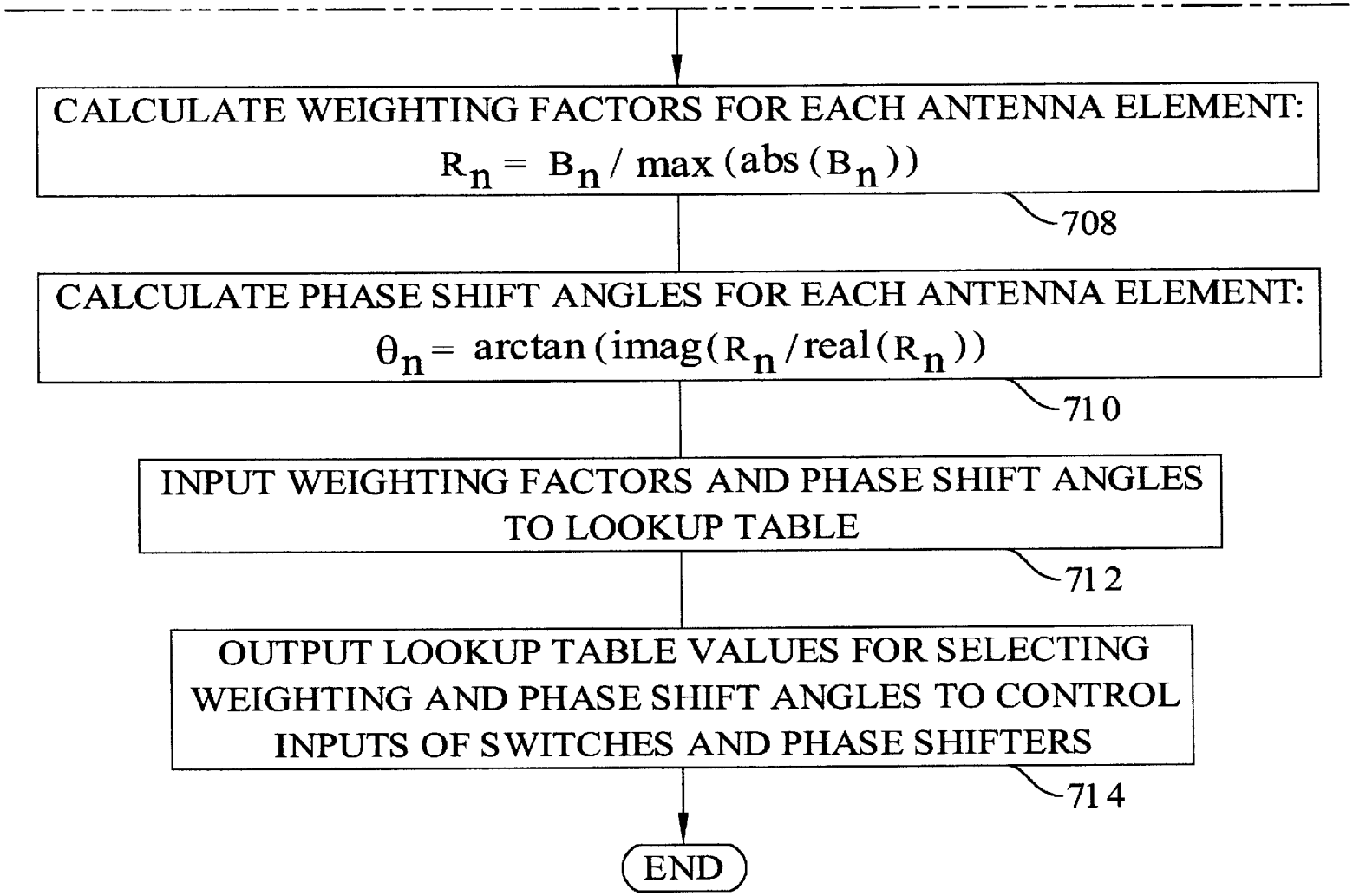

FIG. 7. is a diagram of a flow chart 70 for a computer program implementing the array synthesis method of the present invention using a computer (not shown) to generate control inputs for phase shifters 400, SP16T switches 500, and SP8T switches 602 for antenna elements 606.

At step 702 beamforming matrix Z is calculated from equation (2). Matrix Z is used at step 704 to calculate matrix Q from equation (3). Matrix Q is used in step 706 to calculate the complex transmit signal amplitude $B_n$ for each antenna element to minimize mean square error relative to the desired beam pattern $F(\phi)$ from equation (5). In step 708 an amplitude weight $R_n$ for each $n^{th}$ antenna element is calculated from the transmit signal amplitudes $B_n$ in equation (6). The phase shift angle $\theta_n$ is calculated at step 710 from equation (7) using the amplitude weights calculated in step 708. In step 712 the amplitude weights and phase shift angles calculated in steps 708 and 710 are input to a lookup table. In step 714 the lookup table outputs appropriate bit patterns for driving control inputs 410 of phase shifters 400, control inputs 506–514 of SP16T switches 500, and control inputs 604 of SP8T switches 602. The bit patterns may be output from a computer implementing the program flow chart of FIG. 7 to array synthesizer 10 by, for example, a parallel I/O port.

Other modifications, variations, and applications of the present invention may be made in accordance with the above teachings other than as specifically described to practice the invention within the scope of the following claims.

What is claimed is:

1. A method for steering a beam for an antenna array comprising the following steps:

calculating for each antenna element of an active sector of an antenna array an amplitude weight and a phase shift angle of a transmit signal that minimizes an error function of a desired beam pattern of the antenna array relative to a calculated beam pattern, wherein the error function is calculated as follows:

$$I = \sum_{m=1}^{M} \left\{ \left[ F(\Phi_m) - \sum_{n=n1}^{n2} B_n Z(n, m) \right] \left[ F^*(\Phi_m) - \sum_{k=n1}^{n2} B_k^* Z(k, m)^{*T} \right] \right\}$$

wherein:

I≡mean square beam pattern error;

M≡number of azimuth angles for which the electric field values of the antenna elements are known;

F≡desired electric field of the antenna array;

$\phi_m$≡one of M azimuth angles for which the electric field values of the antenna elements are known;

n1≡first element of the active sector;

n2≡last element of the active sector;

$B_n$≡complex current input to the $n^{th}$ antenna element;

$$Z(n,m)=e_n(\phi_m-\phi_n)\exp(2\pi jf\{x_n \cos(\phi_m)+y_n \sin(\phi_m)\}/c);$$

$e_n(\phi_n)$≡a normalized electric field of the $n^{th}$ antenna element;

$x_n,y_n$≡location of the $n^{th}$ antenna element;

$j\equiv\sqrt{-1}$;

f≡transmit signal frequency; and c≡speed of light;

weighting the transmit signal for each antenna element by a selected amplitude weight approximating the calculated amplitude weight; and phase shifting the weighted transmit signal for each antenna element by a selected phase shift angle approximating the calculated phase shift angle.

2. The method of claim 1 wherein the amplitude weight for the $n^{th}$ antenna element is calculated as follows:

$$R_n=B_n/\max(abs(B_n))$$

wherein:

$R_n$≡amplitude weight of the $n^{th}$ antenna element;

$$B_n = \sum_{m=1}^{M} \left[ F(\Phi_m) \sum_{k=n1}^{n2} Z(k, m)^{*T} Q(k, n)^{-1} \right];$$

and $$Q(n, k) = \sum_{m=1}^{M} Z(n, m) Z(k, m)^{*T}.$$

3. The method of claim 2 wherein the phase shift angle for the $n^{th}$ antenna element is calculated as follows:

$$\theta_n=\arctan[imag(R_n)/\mathrm{real}(R_n)]$$

wherein $\theta_n$≡phase shift angle of the $n^{th}$ antenna element.

4. A computer program product:

a medium for embodying a computer program for input to a computer; and a computer program embodied in said medium for coupling to the computer to steer a beam of an antenna array by performing the following functions;

calculating for each antenna element of an active sector of an antenna array an amplitude weight and a phase shift angle of a transmit signal that minimizes an error function of a desired beam pattern of the antenna array relative to a calculated beam pattern;

wherein the error function is calculated as follows:

$$I = \sum_{m=1}^{M} \left\{ \left[ F(\Phi_m) - \sum_{n=n1}^{n2} B_n Z(n, m) \right] \left[ F^*(\Phi_m) - \sum_{k=n1}^{n2} B_k^* Z(k, m)^{*T} \right] \right\}$$

wherein:

I≡mean square beam pattern error;

M≡number of azimuth angles for which the electric field values of the antenna elements are known;

F≡desired electric field of the antenna array;

$\phi_m$≡one of M azimuth angles for which the electric field values of the antenna elements are known;

n1≡first element of the active sector;

n2≡last element of the active sector;

$B_n$≡complex current input to the $n^{th}$ antenna element;

$$Z(n,m)=e_n(\phi_m-\phi_n)\exp(2\pi jf\{x_n \cos(\phi_m)+y_n \sin(\phi_m)\}/c);$$

$e_n(\phi_n)$≡a normalized electric field of the $n^{th}$ antenna element;

$x_n,y_n$≡location of the $n^{th}$ antenna element;

$j\equiv\sqrt{-1}$;

f≡transmit signal frequency; and c≡speed of light;

outputting to the antenna a an approximation of the calculated amplitude weight to select an amplitude weight for each antenna element; and outputting to the antenna array an approximation of the calculated phase shift angle to select a phase shift angle for each antenna element.

5. The computer program product of claim 4 wherein the amplitude weight for the $n^{th}$ antenna element is calculated as follows:

$$R_n=B_n/\max(abs(B_n))$$

wherein:

$R_n$≡amplitude weight of the $n^{th}$ antenna element;

$$B_n = \sum_{m=1}^{M} \left[ F(\Phi_m) \sum_{k=n1}^{n2} Z(k, m)^{*T} Q(k, n)^{-1} \right];$$

and $$Q(n, k) = \sum_{m=1}^{M} Z(n, m) Z(k, m)^{*T}.$$

6. The computer program product of claim 5 wherein the phase shift angle for the $n^{th}$ antenna element is calculated as follows:

$$\theta_n=\arctan[imag(R_n)/\mathrm{real}(R_n)]$$

wherein $\theta_n$≡phase shift angle of the $n_{th}$ antenna element.

* * * * *